US008459474B2

(12) United States Patent
Sagel

(10) Patent No.: US 8,459,474 B2
(45) Date of Patent: Jun. 11, 2013

(54) ROTARY FITTING FOR A CORNER CUPBOARD COMPRISING A ROTATING SUPPORTING COLUMN

(75) Inventor: Claus Sagel, Bielefeld (DE)

(73) Assignee: Vauth-Sagel Holding GmbH & Co. KG, Brakel (DE)

( * ) Notice: Subject to any disclaimer, the term of this patent is extended or adjusted under 35 U.S.C. 154(b) by 213 days.

(21) Appl. No.: 13/026,357

(22) Filed: Feb. 14, 2011

(65) Prior Publication Data

US 2012/0205333 A1 Aug. 16, 2012

(51) Int. Cl.

| | |
|---|---|
| ***A47F 5/02*** | (2006.01) |
| ***B25G 3/00*** | (2006.01) |
| ***F16M 11/08*** | (2006.01) |

(52) U.S. Cl.

USPC ..... 211/144; 403/398; 248/349.1

(58) Field of Classification Search

USPC ..... 211/144, 163, 131.1, 95, 78, 207, 211/208, 205, 196, 166; 248/349.1, 235, 248/239, 241, 244, 243, 250; 108/94, 95, 108/139, 141; 312/125, 135, 305, 238; 403/398, 403/397

See application file for complete search history.

(56) References Cited

U.S. PATENT DOCUMENTS

| | | | | | |
|---|---|---|---|---|---|
| 2,947,556 | A * | 8/1960 | Wenger | 403/290 |
| 3,982,800 | A * | 9/1976 | Gorton et al. | 312/305 |
| 4,181,037 | A * | 1/1980 | Boon et al. | 74/569 |
| 4,433,885 | A * | 2/1984 | Baker | 312/305 |
| 4,587,908 | A * | 5/1986 | DeBruyn | 108/142 |
| 4,688,686 | A * | 8/1987 | Mitts et al. | 211/183 |
| 5,279,429 | A * | 1/1994 | Sagel | 211/131.1 |
| 5,312,003 | A * | 5/1994 | Domenig | 211/144 |
| 5,494,346 | A | 2/1996 | Domenig | |
| 6,017,108 | A | 1/2000 | Domenig | |
| RE37,943 | E * | 12/2002 | Domenig | 312/305 |
| 6,991,305 | B2 * | 1/2006 | Gallea | 312/238 |
| RE39,917 | E | 11/2007 | Domenig et al. | |
| 7,922,016 | B1 * | 4/2011 | Domenig et al. | 211/144 |
| 8,051,994 | B2 * | 11/2011 | Jin et al. | 211/163 |
| 8,210,373 | B2 * | 7/2012 | Liao | 211/131.1 |
| 2005/0194873 | A1 | 9/2005 | Hoffman | |
| 2009/0230069 | A1 * | 9/2009 | Naden et al. | 211/144 |
| 2011/0127228 | A1 * | 6/2011 | Sagel | 211/144 |
| 2011/0163056 | A1 * | 7/2011 | Domenig et al. | 211/144 |

* cited by examiner

*Primary Examiner* — Jennifer E Novosad
(74) *Attorney, Agent, or Firm* — Thomas | Horstemeyer, LLP

(57) ABSTRACT

A rotary fitting for a corner cupboard comprises a lower and an upper mounting bracket; a supporting column having a main tube and being designed to be rotary mounted to the mounting brackets such that it rotates about its longitudinal axis; and at least two pie cut-shaped shelves to be supported by the supporting column fixed for rotation with the main tube. The supporting column includes a lower length adjusting assembly comprising a support element fixed in the main tube and comprising a recess; a screw element having a head fitting in the recess and a threaded shaft; a nut element arranged on the threaded shaft; and a lower end element fixed to the nut element and movable within the main tube; and an upper length adjusting assembly comprising a tube element partially arranged within the main tube; and a clamping element releasably clamping the tube element.

19 Claims, 10 Drawing Sheets

ROTARY FITTING FOR A CORNER CUPBOARD COMPRISING A ROTATING SUPPORTING COLUMN

FIELD OF THE INVENTION

The present invention generally relates to a rotary fitting for a corner cupboard having a bottom wall and a top wall. Particularly the present invention generally relates to a rotary fitting for a corner cupboard, which comprises a supporting column rotating about its longitudinal axis and carrying at least two pie cut-shaped shelves which are fixed for rotation with the supporting column. Even more particularly, the present invention relates to such rotary fittings in which a cupboard corner door element is fixed to the rotary fitting for rotation with the shelves and the supporting column, so that the rotary fitting not only serves for supporting the shelves but also for movably mounting the door element.

The rotary fittings to which the present invention relates belong to a group of rotary fittings or rotary shelf assemblies of a so-called "Lazy Susan" type.

BACKGROUND OF THE INVENTION

With a rotary fitting in which the door element of a corner cupboard is fixed to the supporting column for rotation therewith, aligning the door element with regard to the door opening of the corner cupboard has to be made via the rotary fitting. Adjusting the door element with regard to the door opening particularly includes adjusting the height of the door element within the door opening.

U.S. Pat. No. 4,688,686 discloses a rotary shelf assembly having shelves mounted on a vertical post. The rotary shelf assembly is connected to a cabinet frame by upper and lower mounting brackets interacting with bearing members to support the post. The assembly is adapted to be mounted in the corner of the cabinet frame. To adjust the vertical position of the cabinet frame, the lower bearing element is adjustable by means of a threaded shaft which raises and lowers the vertical post. The threaded shaft is raised and lowered by means of either a knurled cylindrical element or a toothed cylindrical element, accessible through the post by rectangular openings. By rotating the toothed or knurled elements, the shaft of the vertical adjustments means rotates within the mounting bracket, whereby adjusting the height of the rotary shelf assembly.

U.S. Pat. No. 5,494,346 discloses an adjustable shelf assembly, wherein a vertical post rotably mounted in a cabinet supports a plurality of rotatable shelves which carry the cabinet door. To enable the post and the door to be adjusted vertically, a lower bearing element has a slide member affixed to and rotably movable with the post and having a downwardly inclined ramp on its upper end. A pivotally secured bearing member is positioned within and pivotally secured to the post and, when experiencing pivotal movement, moves back and forth relative to the inclined ramp. A screw is threadably received by the bearing member within the post and extends outside thereof to enable manual adjustment. The slide member, bearing member and screw are arranged so that the screw is adjustably accessible when a portion of the door is within the cabinet door opening to provide direct visual door adjustment within the door opening. The lower bearing element has a vertical slot extending transverse of its longitudinal axis to accommodate a locking pin, the slot having a sufficient vertical opening to enable the post to move upwardly and downwardly with respect to the lower bearing element as the bearing member is pivotally displaced and is moved upwardly or downwardly to displace the post. A plurality of securing apertures are provided for locking the slide member in a fixed relationship with the vertical post.

U.S. Pat. No. 6,017,108 discloses a rotary shelf for use within a cabinet which has first and second mounting brackets spaced apart and opposing each other attached to the bottom and the top of the inside of the cabinet. The mechanism includes integrally formed shelves, a shelf and post securing mechanism, wherein a notched member affixed to a mounting bracket cooperatively receives an engaging member to secure the post and shelves in a stationary position. The mechanism also includes a shelf and cabinet opening adjustment mechanism to permit threadable adjustment of the post and carried shelves with respect to the cabinet opening.

US-Patent application publication 2005/0194873 A1 discloses a Lazy Susan device including a centralized support pole with an upper tube and a lower tube. A length adjustment mechanism includes an expansion nut and a threaded insert. Rotation of the upper tube causes the expansion nut to expand outwardly as the upper tube is rotated. The expansion nut moves away from the upper tube. In this way, the effective length of the support pole is lengthened providing for installation and adjustment of the Lazy Susan device in the absence of the need of any tooling.

US reissued patent RE39,917 E discloses a rotary shelf assembly mechanism having shelves mounted on a vertical post arrangement formed by a first lower post and a second upper post. The mechanism is connected to a cabinet by upper and lower mounting brackets interacting with the top and bottom of the cabinet to support the posts and shelves carried thereby. The mechanism is mounted in the corner of the cabinet. To fit the mechanism within the cabinet, a height adjustment device is formed by positioning the second upper post in the upper end of the first lower post for slidable movement therebetween. When securement of the two joined posts and mounted shelves is desired, the slidably movable second upper post is extended upwardly until it engages the upper mounting bracket mounted on the cabinet. An elongated recess in the second upper post aligns with an opening in the first lower post, and a threaded member extends into a casting positioned within the upper post. The threaded member is tightened to engage the casting and secure the two posts in a shelf-retaining and rotational mode. The height adjustment device enables quick and efficient installation of the mechanism within the cabinet interior. The mechanism also includes a one-piece shelf construction having a post-securing section and a shelf-retaining pin.

There still is a need for a rotary fitting which is easily handled and installed and which nevertheless allows for the positive and quick adjustment of the door element of a corner cupboard fixed to the rotary fitting within the door opening of the corner cupboard.

SUMMARY OF THE INVENTION

In one aspect, the present invention provides a rotary fitting for a corner cupboard having a bottom wall and a top wall. This rotary fitting comprises a lower mounting bracket comprising provisions for being fixed to the bottom wall of the corner cupboard; an upper mounting bracket comprising provisions for being fixed to the top wall of the corner cupboard; a supporting column having a main tube, a lower end and an upper end, and being designed to be rotary mounted to the lower mounting bracket with its lower end and to the upper mounting bracket with its upper end such that the supporting column is rotating about its longitudinal axis; and at least two pie cut-shaped shelves to be supported by the supporting column one above the other and to be fixed for rotation with the main tube about the longitudinal axis. The supporting column includes a lower length adjusting assembly comprising: an axial support element fixed in the main tube and comprising a recess; at least one actuation window cut in the main tube below the axial support element; a screw element having a head fitting in the recess, a cylindrical actuation part accessible through the at least one actuation window with the head in the recess, and a threaded shaft; a nut element arranged on the threaded shaft; and a lower end element fixed to the nut element and movable with regard to the main tube along the longitudinal axis but fixed for rotation with the main tube about the longitudinal axis. Further, the supporting column includes an upper length adjusting assembly comprising: a tube element partially arranged within the main tube but extending beyond the main tube at a variable extent; and a clamping element releasably clamping the tube element for fixing the variable extent at which it extends beyond the main tube.

In a more detailed aspect, the present invention provides a rotary fitting for a corner cupboard having a bottom wall and a top wall. This rotary fitting comprises: a lower mounting bracket comprising provisions for being fixed to the bottom wall of the corner cupboard; an upper mounting bracket comprising provisions for being fixed to the top wall of the corner cupboard; a supporting column having a metal main tube, a lower end and an upper end, and being designed to be rotary mounted to the lower mounting bracket with its lower end and to the upper mounting bracket with its upper end such that the supporting column is rotating about its longitudinal axis; and at least two pie-cut-shaped shelves to be supported by the supporting column one above the other and to be fixed for rotation with the main tube about the longitudinal axis. The supporting column includes a lower length adjusting assembly comprising: an axial support element of plastic fixed in the main tube and comprising an undercut recess; at least one actuation window cut in the main tube below the axial support element; a screw element of metal having a head snap-fitting in the recess, a cylindrical actuation part accessible through the at least one actuation window with the head in the recess, and a threaded shaft; a nut element of metal arranged on the threaded shaft; and a lower end element of plastic fixed to the nut element and movable with regard to the main tube along the longitudinal axis but fixed for rotation with the main tube about the longitudinal axis, the lower end element comprising a receptacle receiving the nut element and comprising a rigid cam engaging an aligning element resiliently supported at the lower mounting bracket. Further, the supporting column includes an upper length adjusting assembly comprising: an tube element partially arranged within the main tube but extending beyond the main tube at a variable extent; and a clamping element comprising a sleeve enclosing the tube element and partially extending into the main tube, and comprising a clamping lever supported at the sleeve and having a cam engaging the tube element for releasably clamping the tube element to fix the variable extent at which it extends beyond the main tube.

Other features and advantages of the present invention will become apparent to one with skill in the art upon examination of the following drawings and the detailed description. It is intended that all such additional features and advantages be included herein within the scope of the present invention, as defined by the claims.

BRIEF DESCRIPTION OF THE DRAWINGS

The invention can be better understood with reference to the following drawings. The components in the drawings are not necessarily to scale, emphasis instead being placed upon clearly illustrating the principles of the present invention. In the drawings, like reference numerals designate corresponding parts throughout the several views.

DETAILED DESCRIPTION

Figure 1:
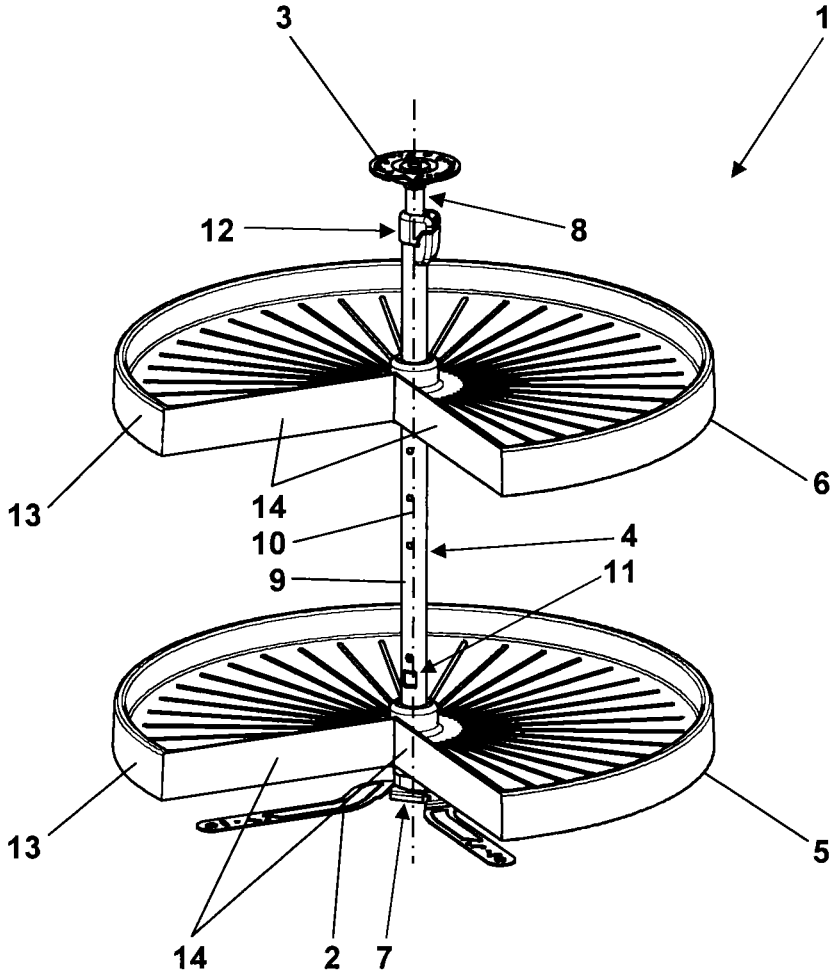
FIG. 1 is a perspective view of the completely assembled rotary fitting according to the present invention.

In a rotary fitting for a corner cupboard according to the present invention, a supporting column of the rotary fitting includes a lower length adjusting assembly. This lower length adjusting assembly comprises an axial support element which is fixed in a main tube of the supporting column and comprises a recess in its lower end side. This recess receives a head of a screw element. The screw element further has a cylindrical actuation part and a threaded shaft. The cylindrical actuation part is accessible from outside the main tube through at least one actuation window cut in the main tube below the axial support element. Through this actuation window the cylindrical actuation part of the screw element may be rotated about the longitudinal axis of the supporting column such that a nut element screwed on the threaded shaft moves upwards downwards with regard to the axial support element. This nut element on the threaded shaft is fixed to a lower end element of the supporting column both with regard to movement with the lower end element in axial or longitudinal direction and in rotation direction about the longitudinal axis of the supporting column. Thus, moving the nut element upwards or downwards also means moving the lower end element which is movable with regard to the main tube along the longitudinal axis but fixed for rotation with the main tube about the longitudinal axis. As the end element of the supporting column is that part of the supporting column mounted to the lower mounting bracket, rotating the screw element results in raising or lowering the main tube with regard to the lower mounting bracket and thus any shelves of the rotary fitting supported by the supporting column and any cupboard corner door element directly mounted to the supporting column or to the shelves. Thus, height adjustment of the door element is very easy with the new rotary fitting. Further, assembly of the new rotary fitting is easy in that after fixing the nut to the lower end element, which may even be made in one part with the nut, one only has to screw the screw element in the nut and to insert the lower end element with the screw element into the lower end of the main tube, where the axial support element has been fixed previously. Even further, it proves to be unnecessary to provide any means for fixing the rotational position of the screw element with regard to the nut as no moments or forces on the screw element engaging the nut occur in normal operation of the new rotary fitting, which would cause an undesired rotational movement of the screw element with regard to the nut.

The axial support element may be fixed in the main tube by one, preferably two or even more rivets which are riveted into the axial support element through holes in the main tube.

The axial support element is preferably made of plastic, whereas the screw element is preferably made of metal, which provides for a noise avoiding material combination.

Preferably, the recess in the lower end side of the axial support element is undercut in such a way that the head of the screw element is snap-fitting in the recess. This snap-fitting holds the screw element plus the lower end element in the main tube once they have been assembled even during rough further handling and transport of the rotary fitting.

When the screw element made of metal with its head in the recess is contacting the axial support element made of plastic via at least one roughened surface, the resulting friction between these two components avoids any undesired rotation of the screw element with regard to the axial support element.

In a preferred embodiment of the new rotary fitting, the lower end element is a shaped plastic body comprising a receptacle receiving the nut element of metal. This shaped plastic body may comprise a web engaging at least one open longitudinal slot provided at the lower end of the main tube. The web in the slot ensures rotation of the lower end element with the main tube but allows for longitudinal relative movement.

Most preferably, the main tube comprises at least one pair of opposing holes receiving a cross-pin which extends through a longitudinally elongated opening in the lower end element and which supports the lowest one of the shelves of the new rotary fitting. This cross-pin also secures the lower end element in the main tube and additionally cares for rotation of the lower end element with the main tube. The extension of the longitudinally elongated opening in the lower end element defines the maximum extent of relative movement between the lower end element and the main tube in the direction of the longitudinal axis.

The cross-pin supporting the lowest of the shelves of the rotary fitting may simply snap-fit into an undercut bottom recess in the shelf. Such a cross-pin may also be provided for implementing the support of any other of the shelves on the main tube.

In principle, one could also provide the lower end element with an opening receiving a cross-pin, wherein the cross-pin extends through a pair of longitudinally elongated holes in the main tube. For stability reasons, however, it is preferred to have the elongated hole in the lower end element.

With all rotary fittings having pie cut-shaped shelves, one has to align the cut-outs of the shelves to the door opening for closing the respective corner cupboard. To this end, some aligning means are generally provided. In the new rotary fitting, such aligning means may be implemented in that the lower end element comprises a rigid cam engaging a aligning element resiliently supported at the lower mounting bracket. The aligning element may preferably be part of a shaped plastic body fixed to the lower mounting bracket made of metal.

The lower mounting bracket of the new rotary fitting preferably comprises two arms laterally extending from a column bearing surface which is engaged by the lower end element of the supporting column. These arms preferably enclose an angle of about 90° such that they may both be fixed to the bottom wall of the corner cupboard close to the door opening of the respective corner cupboard.

When elongated holes oriented in different directions are cut in the two arms of the lower mounting bracket, one may horizontally move the lower mounting bracket to a certain extent even without completely removing screws screwed through these holes into the bottom wall of the corner cupboard. This movement allows for fine adjustment of the horizontal position of the lower mounting bracket which directly affects the horizontal position of the lower end of any door element attached to the new rotary fitting.

A clamping element of an upper length adjusting assembly of the supporting column of the new rotary fitting, which clamps a tube element partially arranged within the main tube but extending beyond the main tube at a variable extent for fixing this variable extent, may comprise a sleeve enclosing the tube element and partially extending into the main tube, and a clamping lever supported at the sleeve and having a cam engaging the tube element. Such a clamping element is known from length adjusting assemblies of stationary parasols. It may not be suited for high axial loads between the tube element and the main tube but such high axial loads do not occur in use of the new rotary fitting even with high loads on its shelves.

An upper end element of plastic may be inserted in the tube element, and a upper mounting bracket of metal may comprise a column bearing surface matching the upper end element in the new rotary fitting. One again there is a noise reducing material combination of plastic, on the one hand, and metal, on the other hand, between moving components of the new rotary fitting.

The at least two pie-cut-shaped shelves of the new rotary fitting are preferably each a one piece-shaped body of plastic, which may be fixed to the main tube by a cross-pin extending through opposing holes in the main tube as already mentioned.

Further, each of the at least to pie cut-shaped shelves may comprise a pair of orthogonal vertical flanges as parts of its rim. These flanges are preferably accessible from a bottom side of the respective shelf for attaching them to a cupboard corner door element. This means that the flanges serve as mounting brackets for the cupboard corner door element in that the door element is directly attached to these flanges by simply screwing screws through the flanges into the backside of the door element.

Referring now in greater detail to the drawings, FIG. 1 shows a rotary fitting 1 including a lower mounting bracket 2, an upper mounting bracket 3, a supporting column 4 and two pie-cut-shaped shelves 5 and 6. The supporting column 4 is mounted to the lower mounting bracket 2 with its lower end 7 and mounted to the supporting bracket 3 with its upper end 8. The shelves 5 and 6 are supported by the supporting column 4 one above the other, and they are fixed for rotation with a main tube 9 of the supporting column 4 about a longitudinal axis 10 of the supporting column 4. Further, the supporting column 4 includes a lower length adjusting assembly 11 and an upper length adjusting assembly 12 which will both be described later. The shelves 5 and 6 are both one piece shaped bodies of plastic. The shaped bodies comprising a rim 13 with two orthogonally extending flanges 14 to which a corner door element (not depicted here) may be mounted by screwing screws through the flanges 14.

Figure 2:
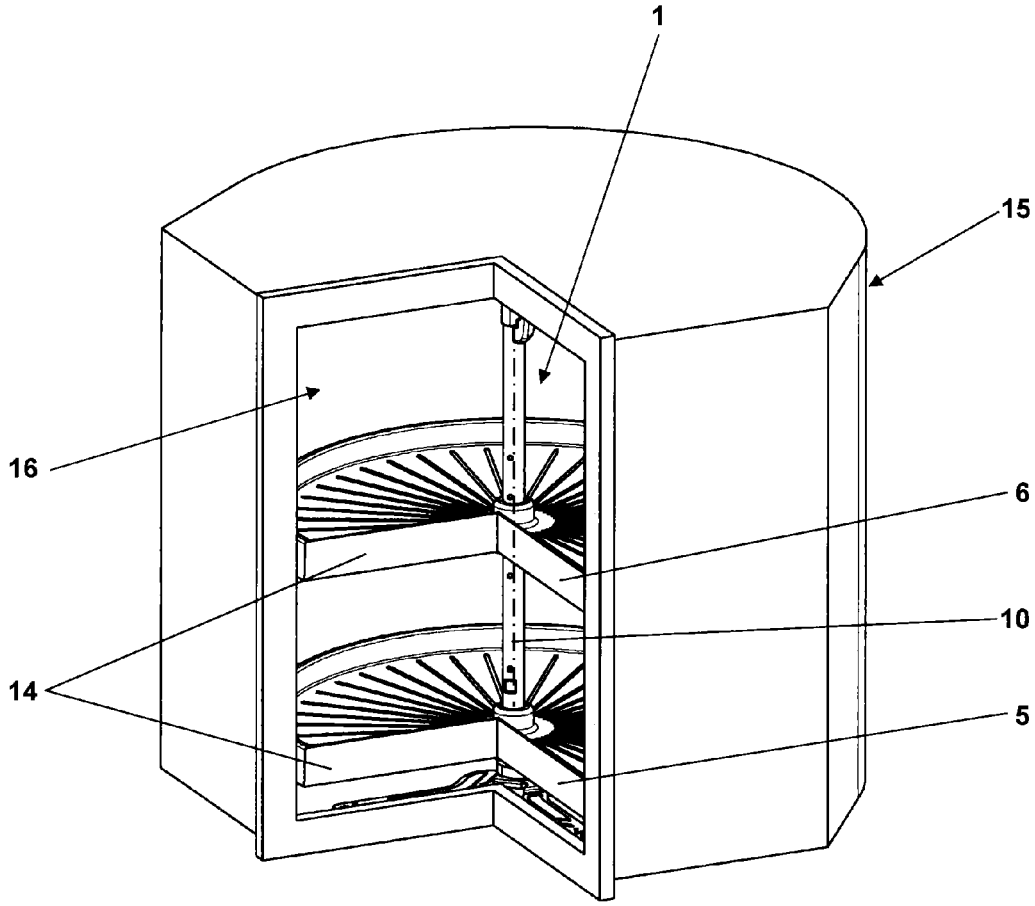
FIG. 2 is a perspective view in the same viewing direction as FIG. 1 of the rotary fitting according to FIG. 1 mounted in a corner cupboard, without a cupboard corner door element.

FIG. 2 shows the rotary fitting 1 mounted in a corner cupboard 15 with the flanges 14 aligned with a door opening 16 of the corner cupboard 15. A corner door element attached to the flanges 14 would thus close the door opening 16. For opening the corner cupboard 15, this door element would be rotated with the shelves 5 and 6 about the longitudinal axis 10 to provide access to any goods stored on the shelves 5 and 6 in the corner cupboard 15.

Figure 3:
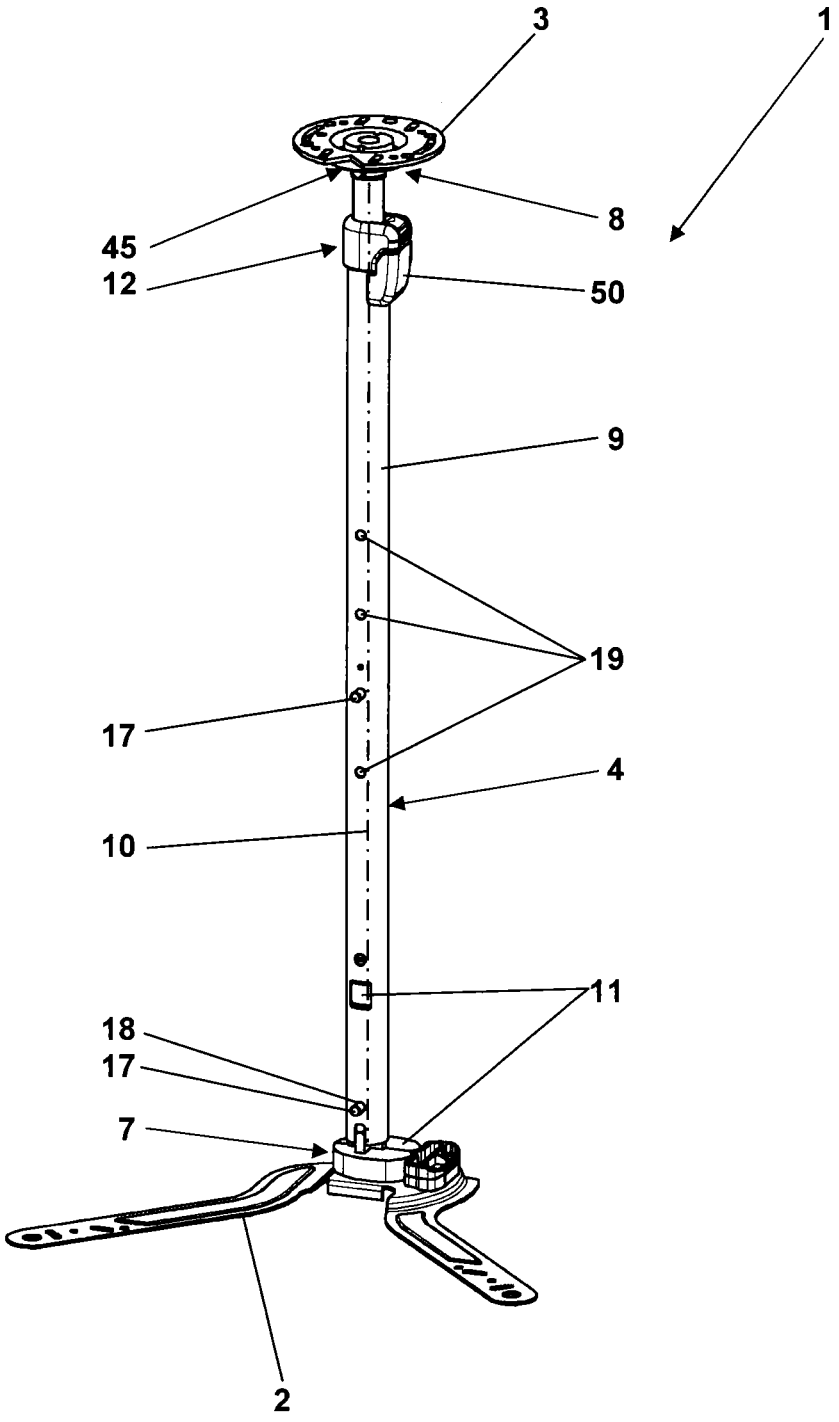
FIG. 3 is a perspective view in the same viewing direction as FIG. 1 of the rotary fitting according to FIG. 1 without its pie cut-shaped shelves.
Figure 4:
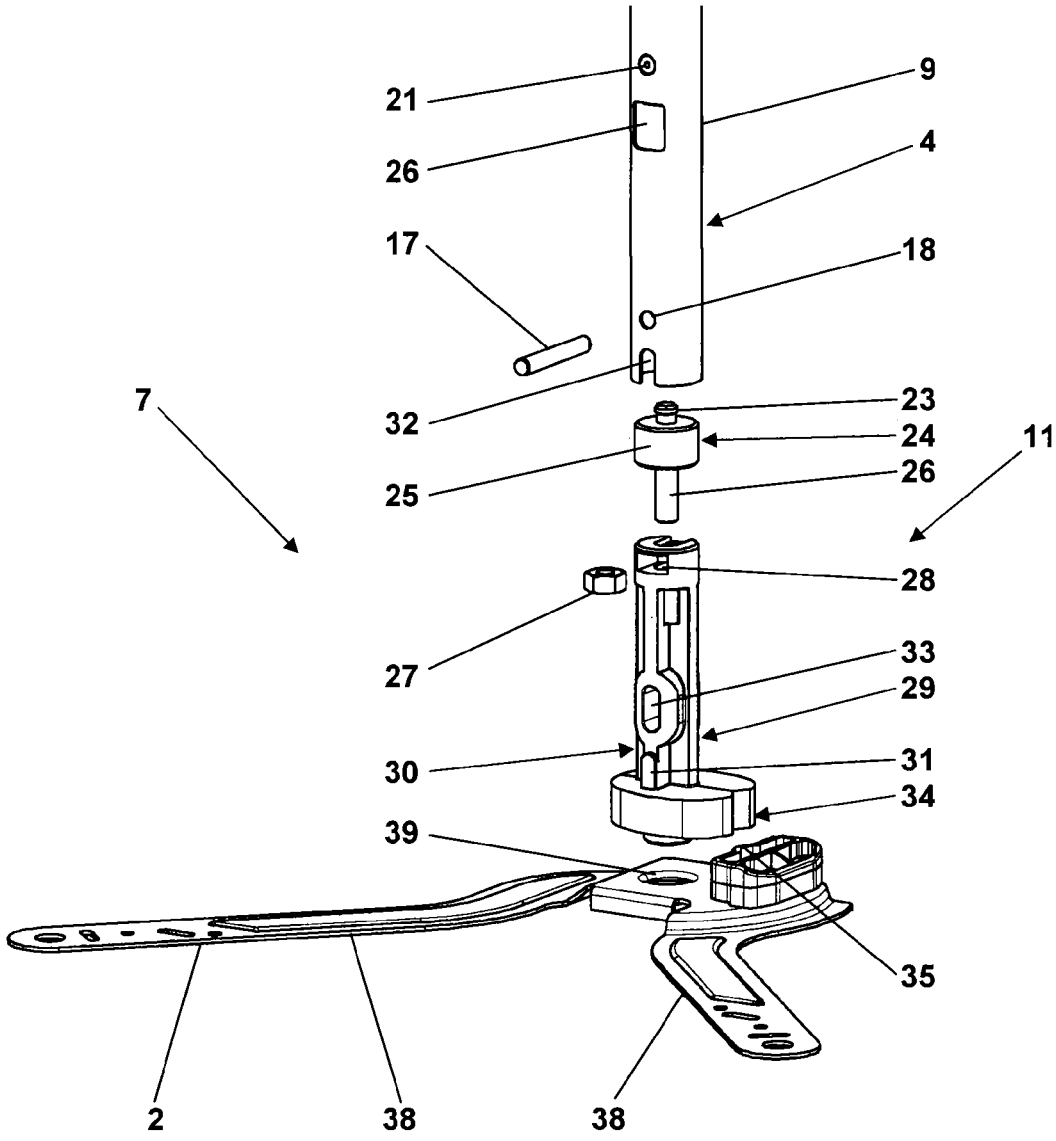
FIG. 4 is a perspective exploded view of a lower mounting bracket and a lower length adjusting assembly of a supporting column of the rotary fitting according to FIG. 1.
Figure 5:
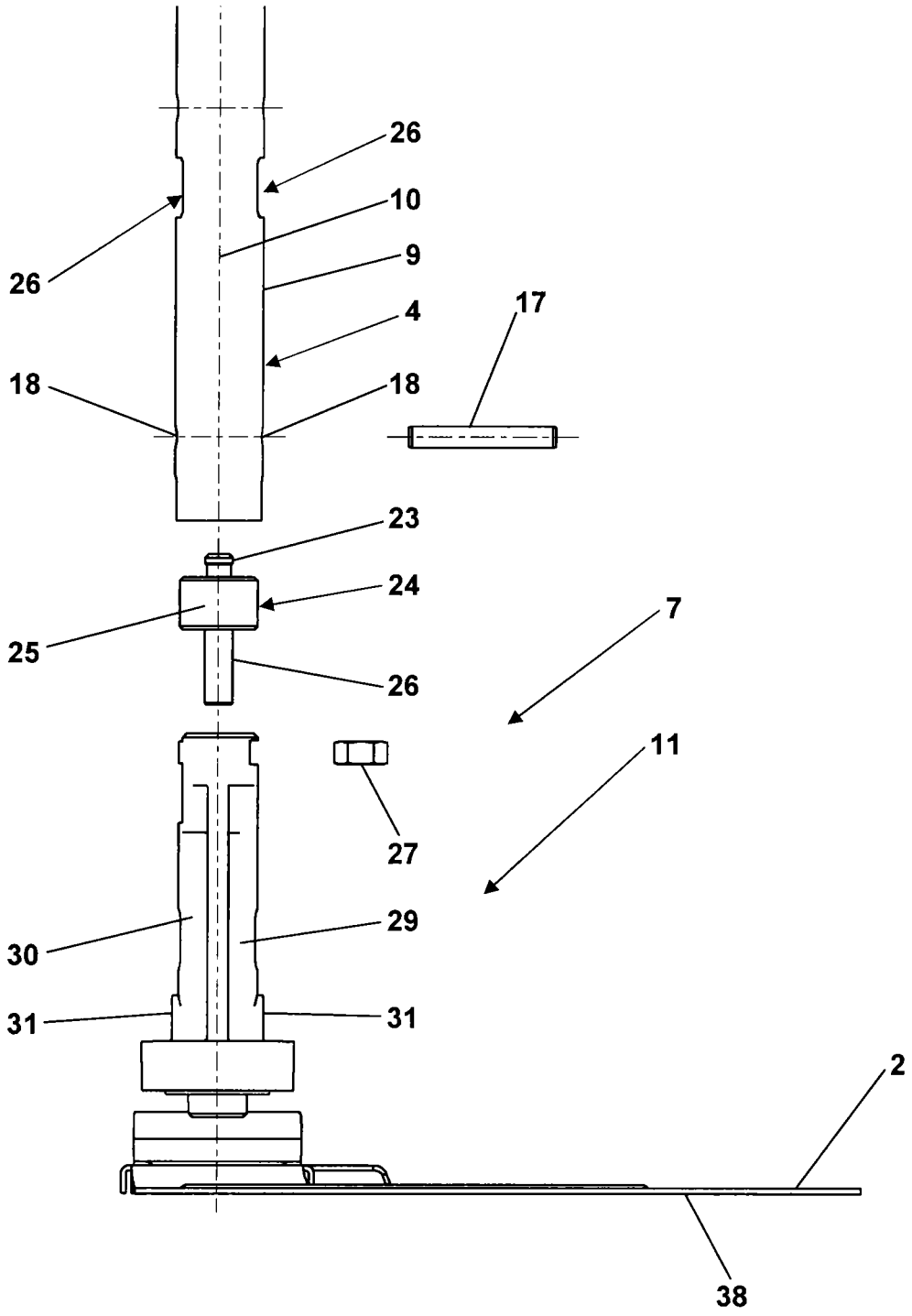
FIG. 5 is an exploded side view showing the same components of the rotary fitting as FIG. 4.

FIG. 3 shows the rotary fitting according to FIG. 1 without the shelves 5 and 6. Here, one can see cross-pins 17 which are provided for supporting the shelves 5 and 6 of FIG. 1. The lower cross-pin 17 has a fixed position through a pair of opposing holes 18. The cross-pin 17 for the upper shelf 6 according to FIG. 1 may be placed in each of a total of four pairs of opposing holes 19 in the main tube 9 to select a desired height for the upper shelf 6.

FIGS. 4, 5, 7 and 8 show the details of the lower length adjusting assembly 11 at the lower end 7 of the supporting column 4. This assembly 11 includes an axial support element 20 fixed in the main tube 9 by two rivets 21. These rivets 21 may be replaced by threaded bolts. The axial support element 10 has a recess 22 in its bottom side. This recess is undercut and a head 23 of a screw element 24 snap-fits into the recess upon assembly of the supporting column 4. The screw element 24 further comprises a cylindrical actuation part 25 which is accessible through two opposing actuation windows 26 cut in the main tube 9, and a threaded shaft 26 extending downwards from the actuation part 25 and engaging a nut 27. This nut 27 is a standard nut which is positively fitted in a receptacle 28 in a shaped body 29 of plastic serving as a lower end element 30 of the supporting column 4. Rotating the screw element 24 about the longitudinal axis shifts the end element 30 along the longitudinal axis 10 as it is fixed for rotation with the main tube 9 by means of webs 31 engaging elongated open holes 32 at the lower end of the main tube 9, and as the cross-pin 17 extending to the opposing holes 18 in the main tube 9 also extends through an elongated hole 33 in the end element 30.

Figure 6:
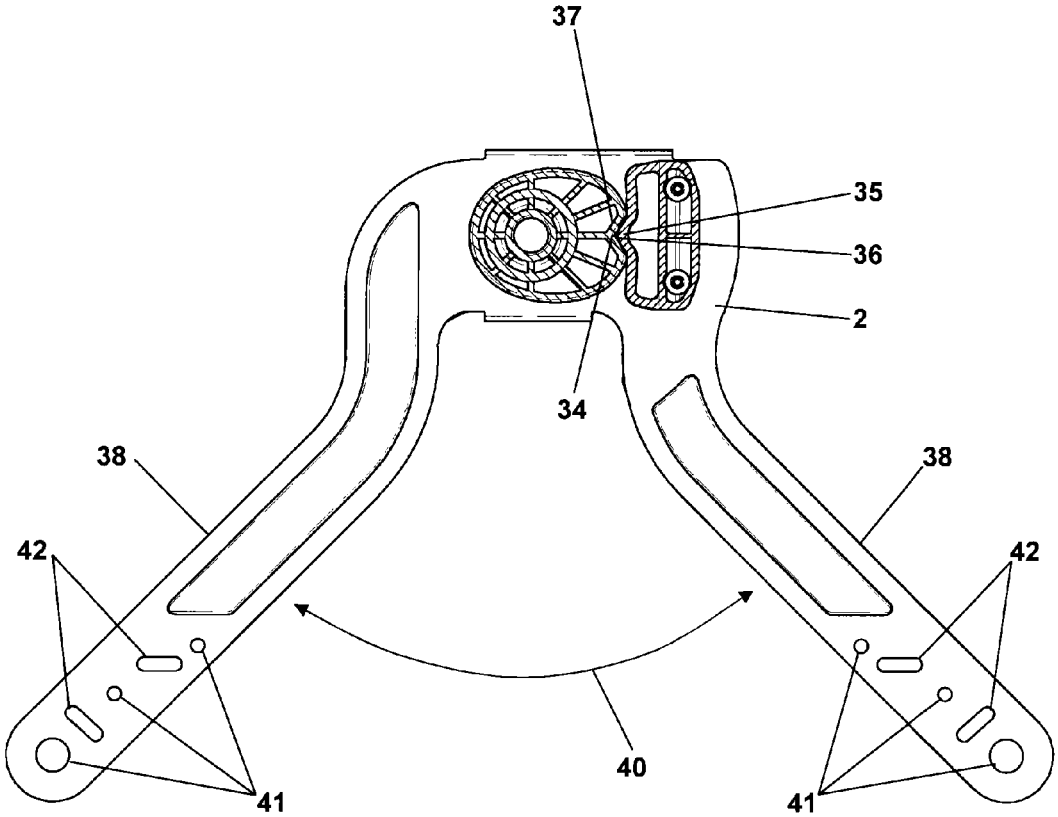
FIG. 6 is a sectional view on a horizontal section plane through a lower end element of the supporting column and the lower mounting bracket from above.
Figure 7:
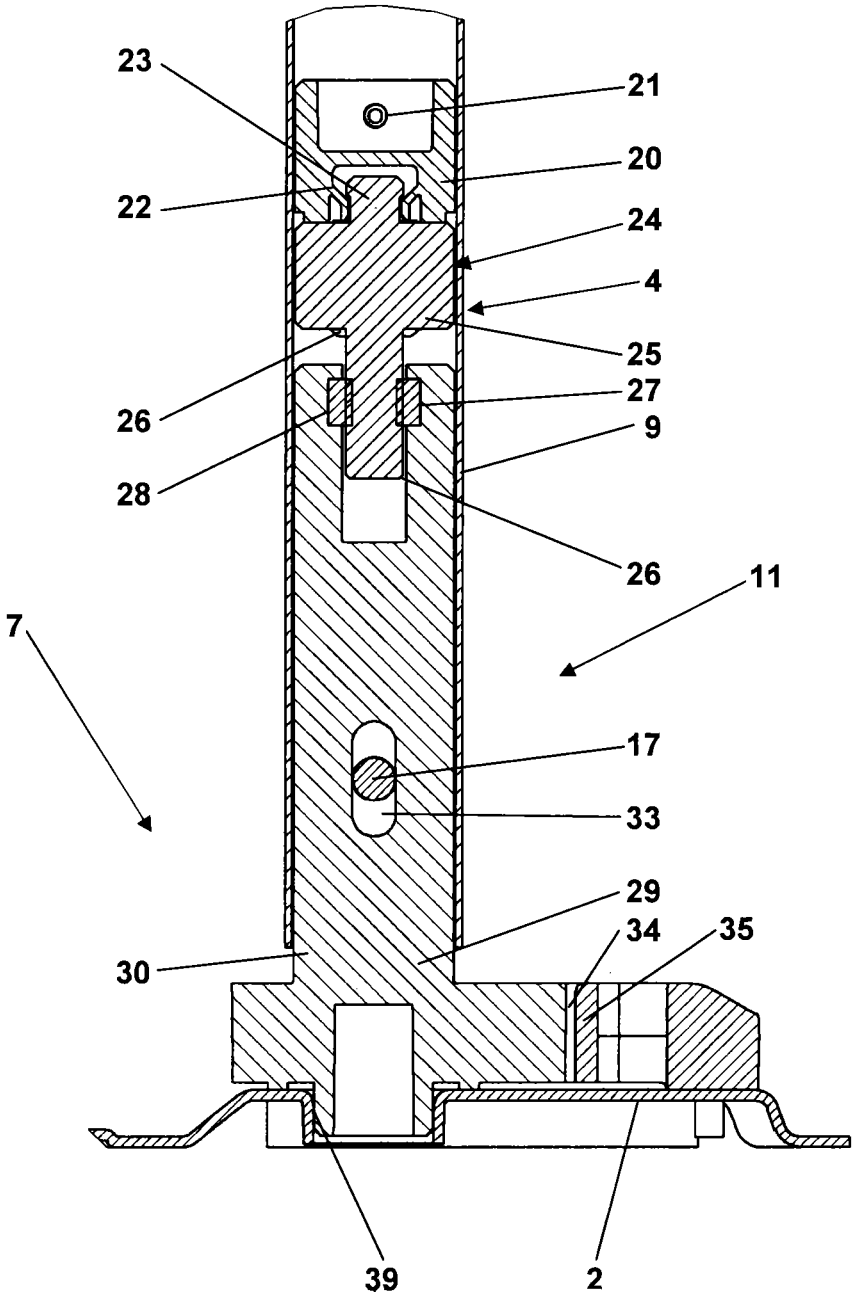
FIG. 7 is a sectional view on a vertical sectional plane of the assembled components according to FIGS. 4 and 5.
Figure 8:
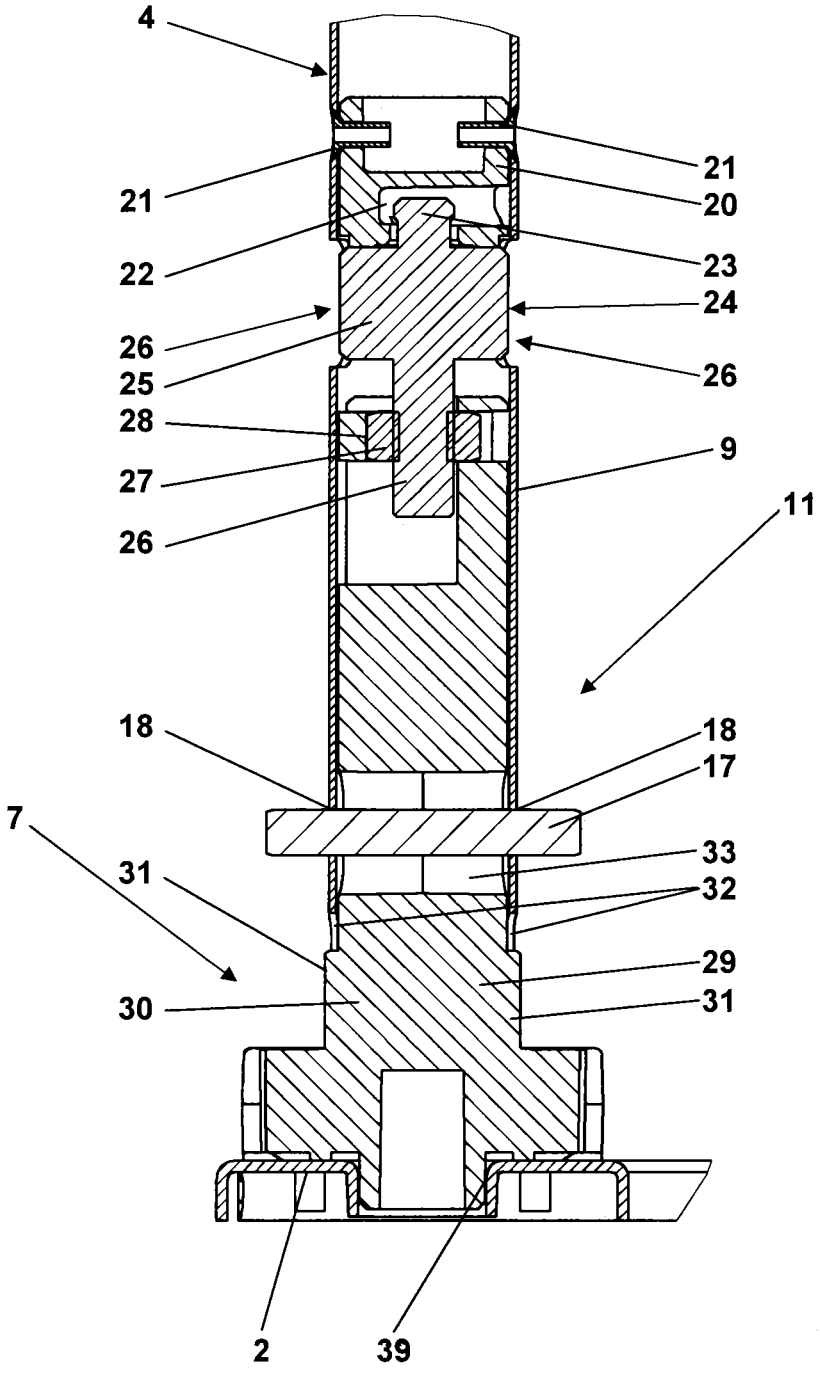
FIG. 8 is a sectional view of the same components as in FIG. 7 but with a vertical sectional plane orthogonal to the sectional plane of FIG. 7.

Further, a rigid cam 34 which is best seen in FIG. 6 is also formed by the shaped plastic body 29. This cam 34 engages an aligning element 35 resiliently supported at the lower mounting bracket 2. Particularly, the aligning element 35 is a resiliently supported nose 36 which form-fits into a notch 37 in the cam 34, when the flanges 14 are aligned with the door opening 16 as shown in FIG. 2. Further, FIG. 6 shows that the lower mounting bracket 2 has two arms 38 laterally extending from a column bearing surface 39 (see FIG. 4), and enclosing a horizontal angle 40 of about 90°. This allows easy alignment of the lower mounting bracket 2 with regard to the door opening 16 as shown in FIG. 2. Both arms 38 are provided with holes 41 and 42 as provisions for being fixed to the bottom wall of the corner cupboard 15 according to FIG. 2. Besides circular holes 41, there are elongated holes 42 allowing for a fine adjustment of the position of the lower mounting bracket 2 even with fastening screws already been screwed through them into the bottom wall of the corner cupboard (prior to being tightened).

Figure 9:
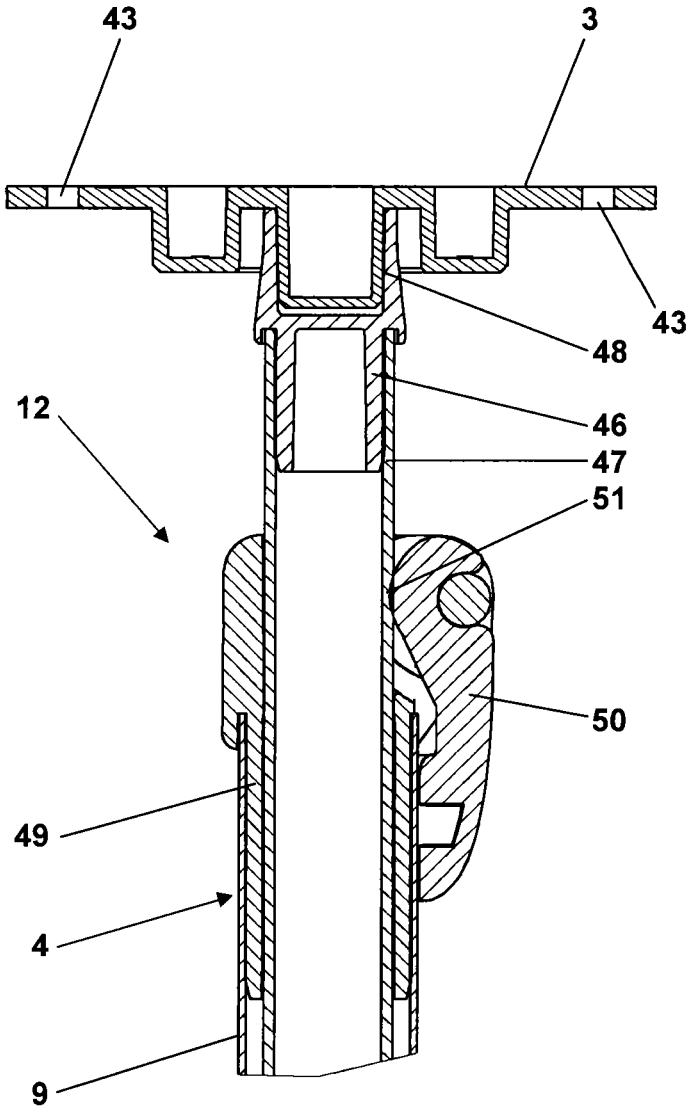
FIG. 9 is a sectional view of an upper length adjusting assembly of the supporting column and an upper mounting bracket of the rotary fitting with a vertical sectional plane.
Figure 10:
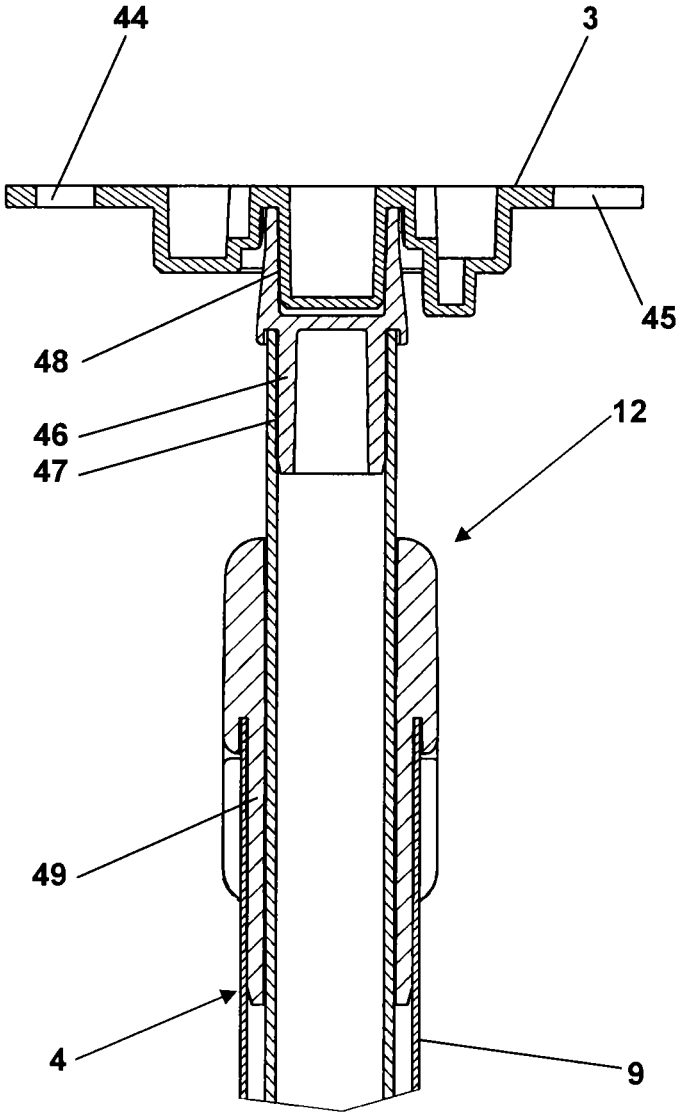
FIG. 10 is a sectional view of the same components as in FIG. 9 with a vertical sectional plane orthogonal to the sectional plane of FIG. 9.

FIGS. 9 and 10 show details of the upper length adjusting assembly 12 and the upper mounting bracket 3. The upper mounting bracket 3 also comprises a plurality of holes 43 and 44 some of which 44 are elongated. Further, a rectangular cut out 45 is provided for aligning the upper mounting bracket 3 with regard to the door opening. The supporting column 4 contacts the upper mounting bracket 3 via an upper end element 46 of plastic which, with its lower part, is inserted into a tube element 47 and which, with its upper part, engages a column bearing surface 48. The tube element 47 extends into the main tube 9 but not directly contacts the main tube 9, as a sleeve element 49 encloses the tube element 47 and partially extends into the main tube 9. A clamping lever 50 is supported at the sleeve element 49 and includes a cam 51 engaging the tube element 47 such as to fix it with regard to the sleeve element 49 and thus with regard to the main tube 9 in longitudinal or vertical direction of the supporting column 4.

In the whole rotary fitting 1 described here, all components which are intended to move with regard to each other in installing and operating the rotary fitting 1 show a combination of two different materials, i.e. plastic and metal. This ensures easy operation and low noise as well as a long lifetime of the actual product.

Many variations and modifications may be made to the preferred embodiments of the invention without departing substantially from the spirit and principles of the invention. All such modifications and variations are intended to be included herein within the scope of the present invention, as defined by the following claims.

I claim:

1. A rotary fitting for a corner cupboard having a bottom wall and a top wall, the rotary fitting comprising:

a lower mounting bracket comprising provisions for being fixed to the bottom wall of the corner cupboard;

an upper mounting bracket comprising provisions for being fixed to the top wall of the corner cupboard;

a supporting column having a main tube, a lower end, an upper end and a longitudinal axis, and being designed to be rotary mounted to the lower mounting bracket with the lower end and to the upper mounting bracket with the upper end such that the supporting column is rotating about the longitudinal axis; and at least two pie cut-shaped shelves to be supported by the supporting column one above the other and to be fixed for rotation with the main tube about the longitudinal axis;

wherein the supporting column includes a lower length adjusting assembly comprising:

an axial support element fixed in the main tube and comprising a lower end side including a recess;

at least one actuation window cut in the main tube below the axial support element;

a screw element having a head fitting in the recess, a cylindrical actuation part accessible through the at least one actuation window with the head in the recess of the axial support element, and a threaded shaft;

a nut element arranged on the threaded shaft; and a lower end element fixed to the nut element, movable with regard to the main tube along the longitudinal axis and fixed for rotation with the main tube about the longitudinal axis; and wherein the supporting column further includes an upper length adjusting assembly comprising:

a tube element partially arranged within the main tube and extending beyond the main tube to a variable extent; and a clamping element releasably clamping the tube element for fixing the variable extent to which the tube element extends beyond the main tube.

2. The rotary fitting according to claim 1, wherein the axial support element is made from plastic and fixed in the main tube by at least two rivets which are riveted into the axial support element through holes provided in the main tube.

3. The rotary fitting according to claim 1, wherein the axial support element is made from plastic, wherein the recess in the lower end side of the axial support element is undercut, and wherein the head of the screw element is snap-fitting in the recess.

4. The rotary fitting according to claim 1, wherein the screw element with the head in the recess is made from metal and contacts the axial support element which is made from plastic via at least one roughened surface.

5. The rotary fitting according to claim 1, wherein the lower end element is a shaped body made from plastic and comprising a receptacle receiving the nut element which is made from metal.

6. The rotary fitting according to claim 1, wherein the main tube comprises a lower tube end including at least one open longitudinal slot, and wherein the lower end element comprises a web engaging the at least one slot.

7. The rotary fitting according to claim 1, wherein the main tube comprises at least one pair of opposing holes receiving a cross-pin, and wherein the cross-pin extends through a longitudinally elongated opening in the lower end element.

8. The rotary fitting according to claim 7, wherein the cross-pin is supporting the lowest one of the at least two shelves.

9. The rotary fitting according to claim 8, wherein the cross-pin snap-fits into an undercut bottom recess in the lowest one of the at least two shelves.

10. The rotary fitting according to claim 1, wherein the lower end element comprises at least one opening receiving a cross-pin, and wherein the cross-pin extends through a pair of longitudinally elongated holes in the main tube.

11. The rotary fitting according to claim 1, wherein the lower end element comprises a rigid cam engaging an aligning element resiliently supported at the lower mounting bracket.

12. The rotary fitting according to claim 11, wherein the aligning element is a part of a shaped plastic body fixed to the lower mounting bracket, which is made from metal.

13. The rotary fitting according to claim 1, wherein the lower mounting bracket is made from metal and comprises two arms laterally extending from a column bearing surface and enclosing a horizontal angle of about 90°.

14. The rotary fitting according to claim 13, wherein elongated holes oriented in different directions are cut in the two arms.

15. The rotary fitting according to claim 1, wherein the clamping element comprises a sleeve element enclosing the tube element and partially extending into the main tube, and a clamping lever supported at the sleeve and having a cam engaging the tube element.

16. The rotary fitting according to claim 1, wherein an upper end element made from plastic is inserted into the tube element and wherein the upper mounting bracket which is made from metal comprises a column bearing surface matching the upper end element.

17. The rotary fitting according to claim 1, wherein the at least two pie cut-shaped shelves are each a one piece-shaped body made from plastic which is to be fixed to the main tube by a cross-pin extending through to opposing holes in the main tube.

18. The rotary fitting according to claim 1, wherein each of the at least two pie cut-shaped shelves comprises a rim including a pair of orthogonal vertical flanges, the flanges being accessible from a bottom side of the respective shelf for attaching the flanges to a cupboard corner door element.

19. A rotary fitting for a corner cupboard having a bottom wall and a top wall, the rotary fitting comprising:

a lower mounting bracket comprising provisions for being fixed to the bottom wall of the corner cupboard;

an upper mounting bracket comprising provisions for being fixed to the top wall of the corner cupboard;

a supporting column having a metal main tube, a lower end, an upper end and a longitudinal axis, and being designed to be rotary mounted to the lower mounting bracket with the lower end and to the upper mounting bracket with the upper end such that the supporting column is rotating about the longitudinal axis; and at least two pie-cut-shaped shelves to be supported by the supporting column one above the other and to be fixed for rotation with the main tube about the longitudinal axis;

wherein the supporting column includes a lower length adjusting assembly comprising:

an axial support element made from plastic, fixed in the main tube and comprising a lower end side including an undercut recess;

at least one actuation window cut in the main tube below the axial support element;

a screw element made from metal and having a head snap-fitting in the recess of the axial support element, a cylindrical actuation part accessible through the at least one actuation window with the head in the recess, and a threaded shaft;

a nut element made from metal and arranged on the threaded shaft; and a lower end element made from plastic, fixed to the nut element, movable with regard to the main tube along the longitudinal axis and fixed for rotation with the main tube about the longitudinal axis, the lower end element comprising a receptacle receiving the nut element and comprising a rigid cam engaging an aligning element resiliently supported at the lower mounting bracket; and wherein the supporting column further includes an upper length adjusting assembly comprising:

an tube element partially arranged within the main tube and extending beyond the main tube to a variable extent; and a clamping element comprising a sleeve enclosing the tube element and partially extending into the main tube, and comprising a clamping lever supported at the sleeve and having a cam engaging the tube element for releasably clamping the tube element to fix the variable extent to which the tube element extends beyond the main tube.

* * * * *